US007035074B2

(12) United States Patent
Langer et al.

(10) Patent No.: US 7,035,074 B2
(45) Date of Patent: Apr. 25, 2006

(54) METHOD AND ARRANGEMENT FOR MONITORING THE DRIVE OF AN ACTUATOR

(75) Inventors: Winfried Langer, Illingen (DE); Bernd Kudicke, Brackenheim (DE); Juergen Eckhardt, Markgroeningen (DE); Klaus Mueller, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 271 days.

(21) Appl. No.: 10/251,867

(22) Filed: Sep. 23, 2002

(65) Prior Publication Data

US 2003/0056762 A1 Mar. 27, 2003

(30) Foreign Application Priority Data

Sep. 22, 2001 (DE) ..... 101 46 781

(51) Int. Cl.
*H01H 71/04* (2006.01)

(52) U.S. Cl. ..... 361/160

(58) Field of Classification Search ..... 361/160, 361/152, 153, 154, 170, 196; 123/478, 480, 123/487, 490

See application file for complete search history.

(56) References Cited

U.S. PATENT DOCUMENTS

| | | | | |
|---|---|---|---|---|
| 4,398,670 | A * | 8/1983 | Hofmann | 239/533.9 |
| 4,627,268 | A * | 12/1986 | Chu | 73/1.42 |
| 5,270,900 | A * | 12/1993 | Alden et al. | 361/153 |
| 5,668,693 | A * | 9/1997 | Tennies et al. | 361/187 |
| 5,690,083 | A * | 11/1997 | Gopp et al. | 123/568.21 |
| 5,829,412 | A | 11/1998 | Klatt et al. | |
| 6,208,497 | B1 * | 3/2001 | Seale et al. | 361/160 |

FOREIGN PATENT DOCUMENTS

| | | |
|---|---|---|
| DE | 44 44 751 | 6/1996 |
| EP | 0 101 850 | 3/1984 |

* cited by examiner

*Primary Examiner*—Stephen W. Jackson
*Assistant Examiner*—Z Kitov
(74) *Attorney, Agent, or Firm*—Walter Ottesen

(57) ABSTRACT

An arrangement for monitoring the drive of an actuator includes an output-stage component which includes a counter. With the aid of the counter, the switch-on time of the actuator is determined. The determined switch-on time is made available to the microcomputer for diagnostic purposes.

14 Claims, 2 Drawing Sheets

METHOD AND ARRANGEMENT FOR MONITORING THE DRIVE OF AN ACTUATOR

BACKGROUND OF THE INVENTION

In modern control systems, actuators (magnetic valves, electric motors, et cetera) are driven by means of drive signals via an output stage comprising integrated circuit loops or discrete components. The drive signals are generated by computer units. An example for driving a magnetic valve for fuel injection in internal combustion engines is disclosed in U.S. Pat. No. 5,829,412. Here, a drive signal is generated by a microcomputer. This drive signal determines the switch-on time of the magnetic valve. The drive signal is converted in a downstream component (called the angle clock) into a drive signal which is supplied to the magnetic valve output stage. The angle clock has the task to convert the drive signal, which is pregiven on a time basis or angle basis, while considering the actual crankshaft angle. The drive signal is then supplied to an output stage which undertakes the actuation of the magnetic valve by supplying current. In this way, a plurality of additional elements are disposed between the output of the drive signal quantity by the computer element and the actual supplying of current to the magnetic valve. These additional elements, especially in the case of a fault, can falsify the conversion of the drive signal quantity. Accordingly, there is a need to monitor this path.

In a corresponding manner, this applies also to other applications wherein additional electronic components are disposed between the output of the drive signal quantity, which is computed by the microcomputer, and the actual supply of current to the actuator. These additional electronic components influence the drive signal quantity.

U.S. Pat. No. 4,580,220 discloses a safety emergency arrangement for the idle operation of motor vehicles. Here, a pulsewidth-modulated drive signal is outputted by a microcomputer to drive an idle actuator. The converted drive signal quantity is detected at the terminals of the electric motor of this actuator and is read back into the microcomputer. The microcomputer then monitors the correct operation of the circuit elements lying between the microcomputer and the electric motor based on a comparison of the outputted signal quantity to the fed-back signal quantity. This analog solution requires a high complexity with respect to circuitry which contains additional sources of fault.

SUMMARY OF THE INVENTION

A monitoring in a simple and reliable manner is provided of the circuit arrangement lying between output stage and microcomputer by the determination of the actual switch-on time of one or several actuators. The path between the output of the drive quantity by the microcomputer and the supply of current to one or more actuators is effectively monitored.

This procedure has special advantages in combination with the control of internal combustion engines, for example, for internal combustion engines having gasoline-direct injection or for diesel wherein additional circuit arrangements (especially an integrated circuit loop) are built in because of the considerable significance of the injection time point between the output of the drive signal quantity and the output stage to establish the angular relationship.

It is especially advantageous that a diagnosis can be made as to whether indeed no injection took place during fuel cutoff in overrun operation.

Furthermore, it is advantageous that it can be determined from the determination of the actual switch-on time of the actuator whether the drive signal quantity is correctly outputted or whether a connecting line is interrupted between the microcomputer and the output stage.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
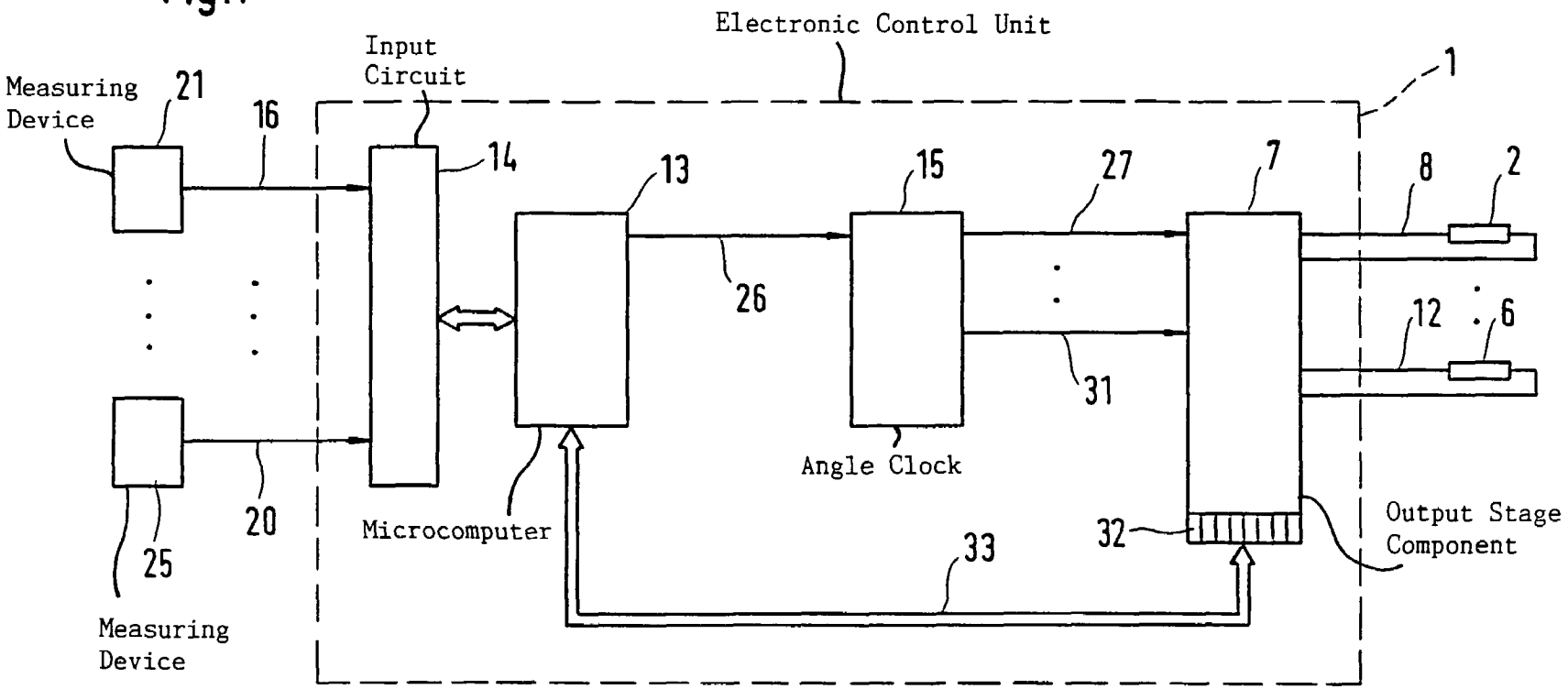
FIG. 1 shows a block circuit diagram of an arrangement for driving an actuator and, in a preferred embodiment, for driving magnetic valves for fuel injection in internal combustion engines; and, FIG. 2 is a flowchart which outlines the procedure of the diagnosis on the basis of the detected switch-on time of the actuator.

FIG. 1 shows an electronic control unit 1, which, inter alia, actuates injection valves 2 to 6 of an internal combustion engine. For this purpose, the control unit 1 includes an output component 7 to which the injection valves 2 to 6 are connected by lines 8 to 12. In addition, the electronic control unit 1 includes a microcomputer 13. The microcomputer 13 is connected at its input end to an input circuit 14, and, at its output end, to a component 15 which includes, for example, a so-called angle clock. Input lines 16 to 20 are connected to the input circuit 14 and these lines connect the control unit 1 to measuring devices 21 to 25 for detecting operating variables of the engine and/or of the vehicle such as engine temperature, engine rpm, exhaust-gas composition, supplied air mass, etc. The input quantities are processed in the input circuit 14 and are supplied to the microcomputer 13. Depending upon the program implemented in the microcomputer, the latter determines drive signal quantities for the actuators 2 to 6 which are outputted via an output line 26 of the microcomputer to the angle clock 15. Depending upon the crankshaft angle, the angle clock 15 converts the drive signal quantities for each actuator into a switch-on time duration during which the actuator elements 2 to 6 are supplied with current.

Furthermore, the output-stage component 7 includes counting means 32 which is connected to the microcomputer 13 via an additional data connection 33.

Depending upon the embodiment, the engine control function programs, which are implemented in the microcomputer 13, determine, as a drive signal quantity for the drive of injection valves, a time duration (injection time) for which the respective injection valves are opened as well as a crankshaft angle at which the injection begins. In other embodiments, especially in diesel engines, the crankshaft angles are determined by the function programs wherein the injection is started and ended. These drive signal quantities are transmitted to the angle clock 15. The angle clock comprises essentially a counter which is dependent upon the crankshaft angle and, in this way, represents the crankshaft angle as well as the time duration. For the individual channels (injection valves), the respectively received drive signal quantities are converted into signals which, at a specific crankshaft angle, supply current to the injection valve (open) by driving the output stage and, after the elapse of a specific time duration or after reaching a further crankshaft angle, the valve is again closed.

The angle clock outputs the drive signal to the output stages in accordance with a determined sequence for the individual injection valves (channels) assigned to the cylinders of the engine.

For diagnosing the path between the microcomputer 13 and the output-stage component 7, a counting means 32 is provided as part of the output-stage component or as a separate digital component. This counting means determines the switch-on time of individual or several magnetic valves. The determined time is called up by the microcomputer 13 via the interface 33. If the drive-signal quantity, which is outputted by the microcomputer 13, or if the sum of several drive signal quantities corresponds to the value determined by the counting means 32, then the transmission and processing of the drive signal quantities has run correctly. However, if this is not the case, then a fault in the region of the transmission and/or processing of the signal quantities, which are outputted by the microcomputer 13, can be assumed.

In a preferred embodiment, the counting means detects the switch-on time durations of the output-stage switching means (transistors) and the counting means is started when: the switching means is switched on, is stopped and when the switching means is again switched off.

For a time-dependent coordination of the output operation and read-out operation, it is provided that, in one embodiment, the microcomputer detects the detected time duration in the context of a fixed, engine rpm dependent time raster or, in another embodiment, the detection operation and readout operation is synchronized by means of corresponding synchronizing signals by the microcomputer. The microcomputer is activated with the output of a signal quantity of the counter which then counts the switch-on times of the valve(s) until the microcomputer reads out the count.

In the preferred embodiment, a digital counter is provided which detects the switch-on times for each injection valve individually or for several injection valves collectively as a sum. A digital counter is provided as a counter which is driven with the aid of the clock signal applied to the output-stage component. Depending upon the requirement, the counter is 8 or 16 bits wide. The counting operation is triggered by a corresponding flank of the input signal and the counting operation is stopped with the inverse flank. Depending upon the embodiment, the counter is configured as an overrun counter having an automatic new start or as a counter having an erase function after the counter read-out.

In other embodiments, each drive channel (injection valve) is assigned its own counting means or a group of drive channels (valves) are assigned counting means for detecting the summed switch-on duration.

An 8-bit counter is used in a realization of the above-described procedure and has a counter resolution of 200 microseconds. This counter defines a summation counter (integration) which sums the switch-on times for all four injection valves of a four-cylinder engine. The integration time is then a maximum of 51 milliseconds. The counter is automatically reset after the read-out of the count.

The above-described procedure is not limited to the drive of injection valves; rather, the procedure is used wherever additional circuit arrangements are provided between the output of at least one drive signal quantity by a microcomputer and the actual drive of at least one actuator wherein the additional circuit arrangements can operate on the drive signal quantity so as to make the latter incorrect in the case of a fault. However, the procedure is also usable when lines are provided between the microcomputer output and the output stage where an interruption or a defect of the lines can lead to an incorrect execution of the command outputted by the microcomputer.

The diagnosis of the correct function on the basis of the determined switch-on time takes place by means of a corresponding diagnostic program in the microcomputer. An example of such a diagnostic program is set forth in the flowchart of FIG. 2.

Figure 2:
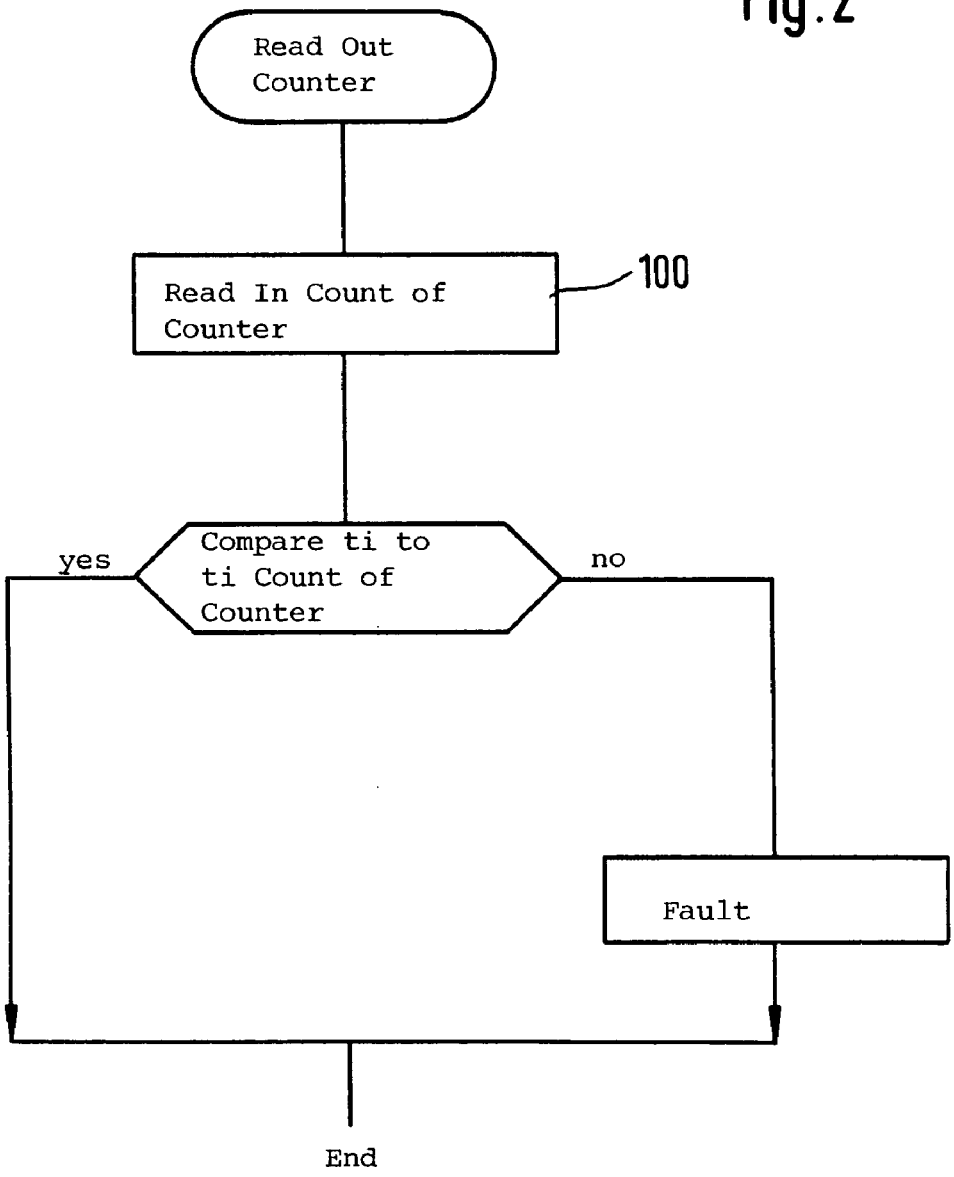

The program starts at pregiven time points with the read-out of the counter. These time points can be dependent upon rpm as may be required. In step 100, the count is read in and thereafter, in step 102, the count is compared to the outputted drive signal quantities, for example, the injection time ti or the sum of a pregiven number of drive signal quantities whose duration was summed (integrated) by the counter. If it was recognized that the count and the outputted time essentially match (in the context of a tolerance), then the program is ended until the next readout of the count. If there is no match recognized in the context of the pre-given tolerance, then, in step 104, a fault is recognized, at least a fault counter is incremented which then generates a fault indication when reaching a specific count. Depending upon the embodiment, and when recognizing a fault, the program shown in FIG. 2 is run through anew with the next readout, of the switch-on-times counter or emergency measures are initiated which comprise, for example, limiting the rpm and/or the speed of the vehicle.

In the above description of a preferred embodiment, digital counting means (counter, integrator, et cetera) are used as part of the output-stage component or as a separate component. In other embodiments, the function of the counting means is assumed by an analog circuit, for example, with a constant current source and capacitor, whose signal is read in by the microcomputer via an analog/digital converter. Depending upon the embodiment, a single switch-on time or the sum of several switch-on times is detected.

The described solution is used not only in combination with injection valves but also in combination with the drive of other magnetic valves such as valves for brake-pressure control or even in combination with electric-motor actuators.

It is understood that the foregoing description is that of the preferred embodiments of the invention and that various changes and modifications may be made thereto without departing from the spirit and scope of the invention as defined in the appended claims.

What is claimed is:

1. A method for monitoring the drive of an actuator, the method comprising the steps of:

outputting at least one changing drive signal from a microcomputer to an output stage circuit and said drive signal representing a switch-on time of said actuator;

detecting a switch-on time duration of said actuator in the region of said output stage circuit utilizing a counting means with said switch-on time duration being the time duration during which said actuator is active or driven;

reading said switch-on time duration into said microcomputer and comparing said switch-on time duration to the corresponding outputted time duration of said changing drive signal; and, if no match of said switch-on time duration and said outputted time duration of said changing drive signal is recognized in the context of a pregiven tolerance, then, detecting a fault or at least incrementing a fault counter.

2. The method of claim 1, wherein said actuator is a magnetic valve for fuel injection.

3. The method of claim 1, wherein said output stage circuit includes a digital counter for detecting said switch-on time duration.

4. The method of claim 2, comprising the further step of determining the individual switch-on time duration of at least one injection valve.

5. A method for monitoring the drive of an actuator, the method comprising the steps of:

outputting at least one changing drive signal variable from a microcomputer to an output stage circuit and said drive signal variable representing a switch-on time of said actuator;

detecting a switch-on time duration of said actuator in the region of said output stage circuit utilizing a counting means;

reading said time duration into said microcomputer and comparing said time duration to the corresponding outputted time duration;

wherein said actuator is a magnetic valve for fuel injection; and, determining the sum of the switch-on time durations of several injection valves.

6. The method of claim 2, comprising a plurality of said actuators and said actuators being respective injection valves and the method comprising the further step of providing a counter for each of said injection valves.

7. The method of claim 2, comprising a plurality of said actuators and said actuators being respective injection valves and the method comprising the further step of providing a counter for a group of said injection valves.

8. The method of claim 1, wherein additional circuit elements are disposed between said microcomputer and said output stage circuit.

9. A method for monitoring the drive of an actuator, the method comprising the steps of:

outputting at least one changing drive signal variable from a microcomputer to an output stage circuit and said drive signal variable representing a switch-on time of said actuator;

detecting a switch-on time duration of said actuator in the region of said output stage circuit utilizing a counting means;

reading said time duration into said microcomputer and comparing said time duration to the corresponding outputted time duration;

wherein additional circuit elements are disposed between said microcomputer and said output stage circuit; and, said additional circuit elements include an angle clock.

10. The method of claim 1, wherein said counting means is a digital counter or an analog counting circuit which is configured as a self-contained component next to said output stage circuit.

11. The method of claim 1, wherein said counting means is an integrator.

12. An arrangement for monitoring a drive of an actuator comprising:

an output stage component connected to said actuator;

a microcomputer including means for supplying a drive signal to said output stage component thereby causing said output stage component to supply current to said actuator;

said output stage component including counting means for detecting a switch-on time duration of said actuator;

said counting means having an output and being operatively connected to said microcomputer to make the detected switch-on time duration available at said output of said counting means to said microcomputer; and, comparator and detecting means for comparing said switch-on time duration to the outputted time duration of said drive signal and, if no match between said time durations is recognized in the context of a pregiven tolerance, then detecting a fault or at least incrementing a fault counter.

13. The arrangement of claim 12, wherein said counting means is integrated into said output stage component.

14. The arrangement of claim 12, wherein said counting means is a separate component next to said output stage component.

* * * * *